United States Patent [19]

Kenigson

[11] Patent Number: 4,729,271

[45] Date of Patent: Mar. 8, 1988

[54] SCREWDRIVER HANDLE

[76] Inventor: Robert H. Kenigson, 811 Kains Ave. #8, Albany, Calif. 94706

[21] Appl. No.: 932,603

[22] Filed: Nov. 20, 1986

[51] Int. Cl.[4] ..... B25B 13/00

[52] U.S. Cl. ..... 81/177.1; 16/110 R; 81/436; 81/489

[58] Field of Search ..... 81/177.1, 180.1, 489, 81/436, 177.2; 43/23; 16/110 R, 116 R; 7/165; 74/551.9; 273/72 R, 81 R

[56] References Cited

U.S. PATENT DOCUMENTS

| | | | |
|---|---|---|---|
| 803,161 | 10/1905 | Hastings | 16/110 R |
| 1,774,207 | 8/1930 | Meissner | 16/116 R |
| 1,816,359 | 7/1931 | Carlin | 81/436 |
| 1,839,835 | 1/1932 | Cook | 81/436 |
| 2,985,209 | 5/1961 | Novelo | 273/81 R |

*Primary Examiner*—Frederick R. Schmidt
*Assistant Examiner*—Robert Showalter
*Attorney, Agent, or Firm*—Julian Caplan

[57] ABSTRACT

A screwdriver handle has helical grooves on the exterior, the threads of the helix being of a buttress type. The handle has a resilient external sleeve the interior of which fits into the helical grooves. When the user grips the sleeve and turns in normal fashion, the resiliency of the groove augments the turning action of the screwdriver blade. The sleeve may have a closed end fitting on top of the handle. The shank of the screwdriver below the handle may be enlarged, formed with circumferential grooves and provided with a resilient sleeve over the enlargement.

3 Claims, 4 Drawing Figures

SCREWDRIVER HANDLE

BACKGROUND OF THE INVENTION

1. Field of the Invention

This invention relates to the art of screwdriver handles and more particularly to resilient grips to augment the torque applied to turn the blade. More particularly, the invention provides grooves on the exterior of the handle, preferably of buttress cross-section, and a resilient sleeve fitting over the handle and formed with complementary internal grooves.

2. Description of Related Art

Resilient sleeves for screwdriver handles are known. However the helical grooves in the handles and interior of the sleeve of the present invention are unique. Further, the use of grooves on the top of the handle and providing the sleeve with an end which has grooves fitting into the top handle grooves is also unique.

SUMMARY OF THE INVENTION

The exterior of a screwdriver handle has helical grooves, the threads of the helices being of a buttress thread configuration. Fitting over the handle is a resilient external sleeve having grooves on its interior which fit into the grooves on the handle. When the user grips the sleeve to turn the blade in normal fashion, the resiliency of the groove augments the turning action. For the same purpose, the top end of the handle may be similarly grooved and the sleeve may have an end fitting on the top of the handle which has complementary projections fitting into the handle grooves.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
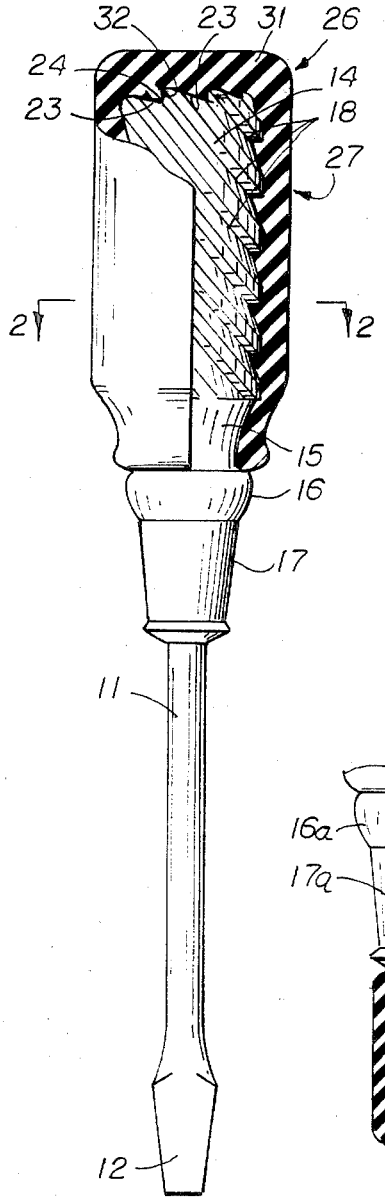
FIG. 1 is a side elevational view of a screwdriver in accordance with the present invention.

The construction of the screwdriver is subject to considerable variation. As shown in FIG. 1, there is a shank 11 having a blade 12 at its lower end and a non-circular portion 13 at its upper end. Handle 14 of wood or plastic receives the upper end 13 of the shank so that turning the handle turns the shank and more particularly the blade 12. Near the lower end of handle 14 is a reduced diameter portion 15 having below it a bead or enlargement 16. Below the enlargement 16 is a ferrule 17 which secures the handle to the blade 11.

A distinguishing feature of handle 14 are the helical external grooves 18 formed thereon. Preferably the grooves 18 have a buttress-type thread in that they have a slanted flank 19 and a perpendicular flank 21.

The top 23 of handle 14 is formed with similar buttress grooves 24.

Fitting around the exterior of handle 14 is a sleeve 26 of rubber or other resilient material. The sides 27 of the sleeve 26 are formed with internal grooves 28 which are complementary to the grooves 18. Preferably sleeve 26 has a closed upper end 31, the interior of which is formed with grooves 32 complementary to the grooves 28. The end 31 protects the palm of the user.

The sleeve 26 is preferably cemented to the handle. Although the sleeve is shown therein as unitary, it could be made up of strips wound parallel to each other, each strip being cemented to the handle.

By reason of the resilient nature of the sleeve 26, when the user flexes and adds torque or energy to the turning motion, he augments the turning motion which he imparts to the handle. Just squeezing the grip only will turn the screw driver bit. The torque action as pressure is applied to the grip 27 is the side for easier turning and downward, thereby aiding in preventing the blade 12 from sliding out of the slot in the screw.

Figure 2:
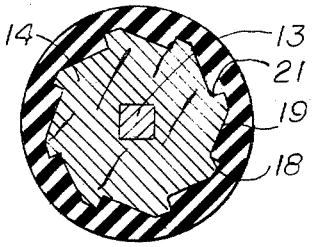
FIG. 2 is a cross-sectional view taken substantially along the line 2—2 of FIG. 1.
Figure 4:
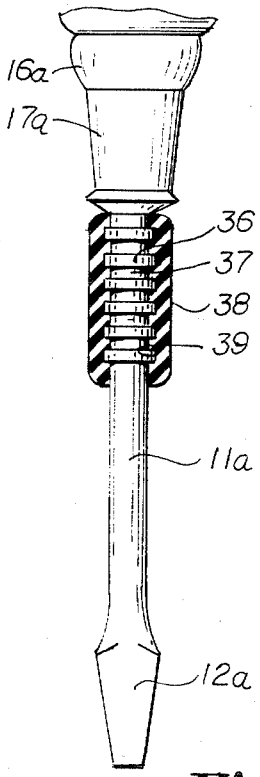
FIG. 4 is a view similar to FIG. 1 of a modification.
Figure 3:
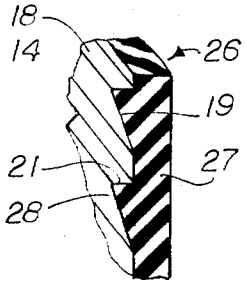
FIG. 3 is an enlarged fragmentary sectional view showing the shapes of the grooves in greater detail.

In the modification of FIG. 4, the upper end of the handle and the sleeve may be formed as in FIGS. 1–3, or may be formed in conventional fashion. The shank **11*a* below handle 14*a* is formed with an enlargement 36 and the exterior of the enlargement 36 has circumferential grooves 37. Surrounding the enlargement 36 is a resilient second sleeve 38 having on its interior grooves 39 which are complementary to the grooves 37. Frequently the user of screwdrivers, instead of turning the handle, prefers to turn the shank and the modification shown in FIG. 4** assists and provides improved grip and greater effectiveness for such purpose.

What is claimed is:

1. A screwdriver or the like comprising a blade, a handle fixed to said blade, said handle being formed with a plurality of helical grooves around the outside and a resilient sleeve fitting tightly around the exterior of said handle, the interior of said sleeve fitting into said grooves, all of said helical grooves curving in the same direction, whereby upon the user twisting said sleeve, said sleeve is stressed and the resiliency of said sleeve augments turning action of said blades the cross-section of said grooves being of buttress-thread shape, having a slanted flank and a perpendicular flank, said perpendicular flank resisting turning of said sleeve relative to said handle where said sleeve is turned in a direction such as to cause said blade to tighten a screw with which it is engaged.

2. A screwdriver according to claim 1 in which said handle is round and the upper end of said handle is formed with buttress-shape second grooves and said resilient sleeve is formed with an end fitting against said upper end of said handle, the interior of said sleeve end fitting into said second grooves, all of said second grooves extending in the same direction, said second grooves having a slanted flank and a perpendicular flank, said perpendicular flank resisting turning of said end of said sleeve relative to said upper end of said handle when said sleeve is turned in a direction such as to cause said blade to tighten a screw with which it is engaged.

3. A screwdriver according to claim 1 in which said screwdriver has a shank below said handle, said shank being formed with circumferential grooves along part of its length and which further comprises a second resilient sleeve around said circumferential grooves.

* * * * *